US007559862B2

(12) United States Patent
Von Heland

(10) Patent No.: US 7,559,862 B2
(45) Date of Patent: Jul. 14, 2009

(54) BALL SUITABLE FOR WATER GAMES

(75) Inventor: Jan Von Heland, Danderyd (SE)

(73) Assignee: Waboba AB, Danderyd (SE)

( * ) Notice: Subject to any disclaimer, the term of this patent is extended or adjusted under 35 U.S.C. 154(b) by 183 days.

(21) Appl. No.: 11/572,776

(22) PCT Filed: May 20, 2005

(86) PCT No.: PCT/SE2005/000749

§ 371 (c)(1),
(2), (4) Date: Jan. 26, 2007

(87) PCT Pub. No.: WO2006/121380

PCT Pub. Date: Nov. 16, 2006

(65) Prior Publication Data

US 2008/0045364 A1 Feb. 21, 2008

(30) Foreign Application Priority Data

May 12, 2005 (WO) ..... PCT/SE2005/000683

(51) Int. Cl.
*A63B 37/08* (2006.01)

(52) U.S. Cl. ..... 473/594; 473/609; 473/352

(58) Field of Classification Search ..... 473/594, 473/595, 596, 600, 603, 609, 574, 575, 352, 473/354, 577

See application file for complete search history.

(56) References Cited

U.S. PATENT DOCUMENTS

| | | | | |
|---|---|---|---|---|
| 3,661,790 | A | 5/1972 | Dean et al. | |
| 3,980,300 | A * | 9/1976 | Hornsby, Jr. | 473/594 |
| 4,952,190 | A * | 8/1990 | Tarnoff et al. | 473/594 |
| 5,026,054 | A * | 6/1991 | Osher et al. | 473/594 |
| 5,190,504 | A * | 3/1993 | Scatterday | 473/594 |
| 5,294,112 | A * | 3/1994 | Smith | 473/610 |
| 5,647,809 | A * | 7/1997 | Yip | 473/594 |
| 6,398,677 | B1 * | 6/2002 | Hergert et al. | 473/599 |
| 6,514,164 | B1 * | 2/2003 | Parrett | 473/603 |
| 6,533,637 | B1 * | 3/2003 | Liao | 473/594 |
| 6,537,125 | B1 * | 3/2003 | Motosko, III | 473/594 |
| 6,905,431 | B2 * | 6/2005 | Pearce et al. | 473/594 |
| 2001/0014633 | A1 | 8/2001 | Moore | |
| 2004/0048018 | A1 | 3/2004 | Pearce | |

OTHER PUBLICATIONS

PCT International Search Report for International Application No. PCT/SE2005/000749, dated Feb. 15, 2006.

* cited by examiner

*Primary Examiner*—Steven Wong
(74) *Attorney, Agent, or Firm*—Myers Bigel Sibley & Sajovec, PA

(57) ABSTRACT

A ball suitable for water games includes a gel section only comprising a gel, an outer elastic shell section provided above an exterior surface of the gel section, and a floating enhancement section in the interior of the ball adjacent the gel section and including a plastic material and a gas. The ball may have both bouncing and floating properties.

10 Claims, 3 Drawing Sheets

BALL SUITABLE FOR WATER GAMES

RELATED APPLICATIONS

The present application is a 35 U.S.C. § 371 national phase application of PCT International Application Serial No. PCT/SE2005/000749, having an international filing date of May 20, 2005, and claiming priority from PCT International Application No. PCT/SE2005/000683, filed May 12, 2005, the disclosures of which are incorporated herein by reference in their entireties. PCT International Application No. PCT/SE2005/000749 was published in the English language and has International Publication No. WO 2006/121380.

FIELD OF THE INVENTION

The present invention generally relates to a ball and in particular the present invention relates to a ball suitable for water games.

BACKGROUND OF THE INVENTION

Balls have for many years been provided for entertainment and amusement of both children and adults. Balls are normally used in such a way that they can bounce at an angle off a hard surface. Also water is an element which is the source of much pleasure for many people.

In the world of sports, balls have been known to be used for long in relation to water, where water polo is a well known game.

Another ball for water games is described in US 2001/0014633, where the interior of the ball is provided with a cavity that is filled with a gas and fluid combination, where the fluid can be a gel and the gas is typically air. This ball is provided for skimming or sliding along the water surface. It does not bounce very well.

Balls are also known to be used for exercise purposes in order to strengthen muscles. One such ball is a ball described in U.S. Pat. No. 6,224,513. This ball comprises a polyurethane core on top of which is provided an elastic shell layer, which comprises LYCRA®.

For some types of water games it is of importance that the ball can bounce off the water surface in a good way, such that the ball when thrown on a water surface can have a trajectory enabling several further bounces. It is then also of importance that the ball at the same time is able to float well.

There is as yet no such ball existing for the field of water games.

For the reasons stated above, and for other reasons stated below which will become apparent to those skilled in the art upon reading and understanding the present specification, there is a need in the art for an improved ball for water games.

SUMMARY OF THE INVENTION

The above-mentioned problems with balls and other problems are addressed by the present invention and will be understood by reading and studying the following specification.

One object of the present invention is therefore directed towards solving the problem of providing a ball for water games that has good bouncing as well as floating properties.

This problem is according to the present invention solved by a ball suitable for water games comprising:

a gel section only comprising a gel;

an outer elastic shell section provided above an exterior surface of the gel section; and a floating enhancement section in the interior of the ball adjacent the gel section and comprising a plastic material and gas.

According to some embodiments of the present invention, the floating enhancement section is of a porous plastic material, where the gas is provided inside the material. The porous plastic material might be styrene-butadiene rubber. It might also be a foamed plastic like foamed polyurethane.

According to some embodiments of the present invention, the floating enhancement section comprises a cavity only filled with gas, for instance air, and having at least one wall made up of a layer of non-porous plastic material. The plastic material of this layer is then preferably a non-porous thermoplastic material such as polyethylene.

According to some embodiments the floating enhancement section is provided as the core of the ball on top of which the gel section is provided. This enables the provision of a relatively small sized ball suitable for use in swimming pools.

According to some embodiments of the present invention the gel section is provided as the core of the ball and the plastic material of the floating enhancement section is provided around the gel section. Here the floating enhancement section has at least one layer of plastic material between the gel core and the outer elastic shell section. In this way it is possible to provide a larger ball suitable for use on lakes or at sea.

The elastic shell section of the ball may furthermore comprise a stretchable fabric layer to which an enhancement layer may or may not be adhered.

With the present invention there is therefore provided a ball that bounces well on water due to the properties of the gel section while at the same time being able to float well because of the floating enhancement section. This is of advantage when a ball is needed that, when thrown on a water surface, can have a trajectory enabling several bounces and also floats well on the water surface

DETAILED DESCRIPTION OF EMBODIMENTS OF THE INVENTION

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims.

Figure 1:
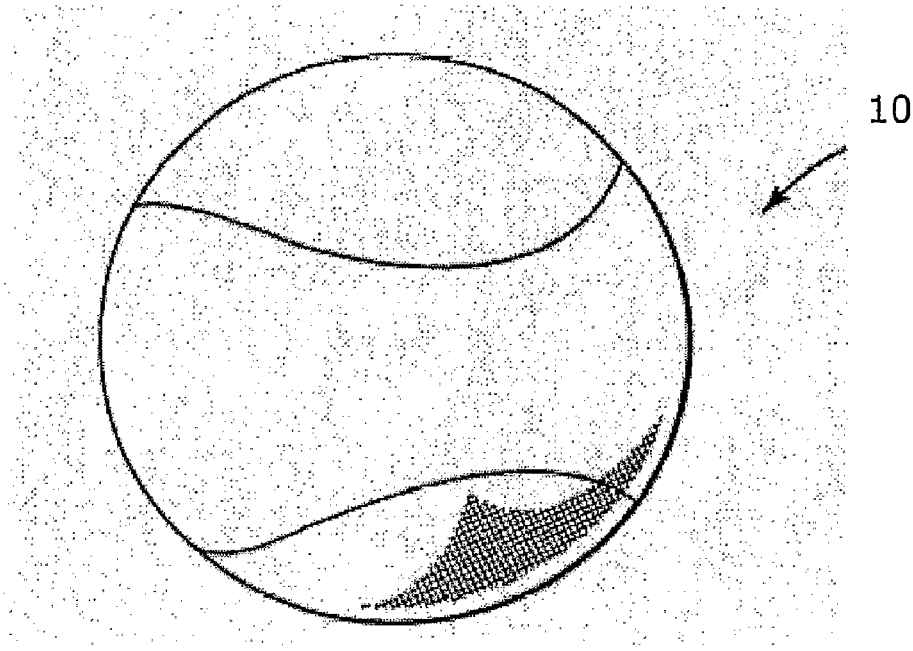
FIG. 1 is a perspective view of a ball of the present invention.

Referring to FIG. 1, a perspective view of one embodiment of a ball 10 of the present invention is provided. This figure will be used in the description of three specific embodiments of the present invention to be discussed in more detail in the following. This ball 10 is suitable for water games. The ball 10, in its normal state is shaped as a round, or spherical ball. In the illustrated embodiment, the ball has stitching to imitate the look of a baseball. It will be appreciated with the benefit of the present specification that balls is not limited to round balls, but other shapes are also feasible, like an oval shape.

Figure 2:
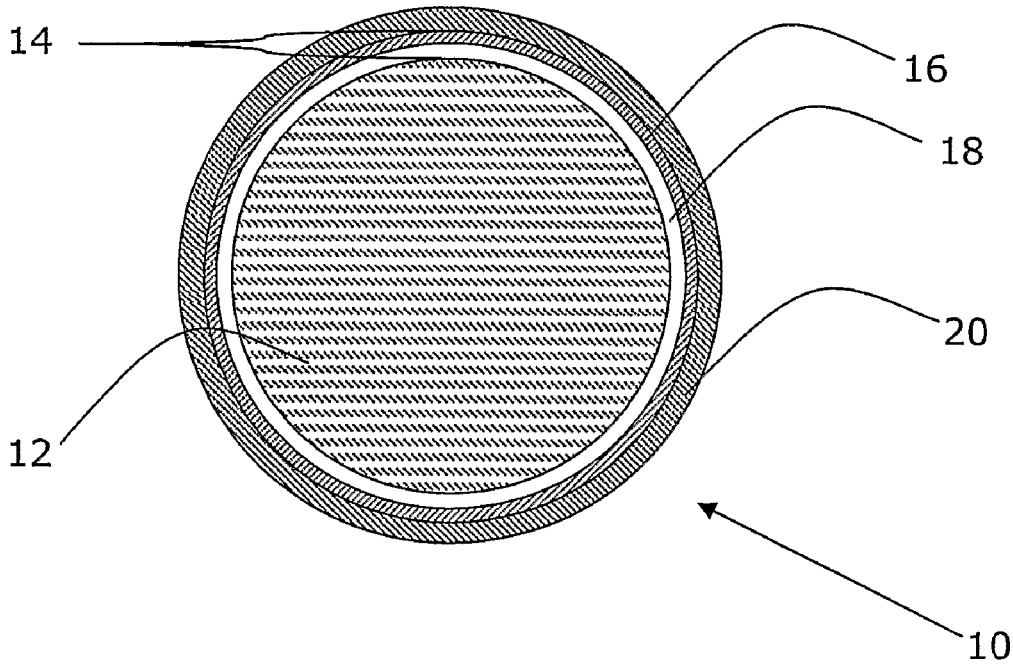
FIG. 2 is a cross-sectional view of the ball of FIG. 1 according to a first embodiment of the present invention.

FIG. 2 displays a cross sectional view taken through a ball 10 according to a first exemplifying embodiment of the present invention and displays the different sections or segments of the ball 10. The ball 10 comprises a gel section 12, which section only comprises a gel and is here the core of the ball 10, around which is provided a floating enhancement section 14. The floating enhancement section 14 here includes a plastic material and gas. For this reason the floating enhancement section 14 includes a thin layer 16 of plastic material. Between the inner surface of the thin layer 16 of plastic material and the outer surface of the gel core 12 there is a closed cavity 18, which cavity 18 is only filled with a gas, like air. The gel core is here one wall of the cavity, while the layer 16 of plastic material is another wall of the cavity 18. Thus the layer 16 of plastic material and cavity 18 together form the floating enhancement section 14 according to this first embodiment. On top of the floating enhancement section 14 there is provided an outer elastic shell section 20. The elastic shell section 20 is thus provided above both the gel section 12 and the floating enhancement section 14 and covers the entire floating enhancement section 14.

The gel has to have very good bouncing properties when used in water, such that the trajectory of the ball when thrown on a water surface enables several bounces of the ball. This allows the provision of a ball that can be used in water games requiring such bouncing characteristics. The gel is preferably a polyurethane based gel and has a density in the area of 1-1.3 g/cm$^3$ and preferably of about 1.05 g/cm$^3$. The gel core 12 has a diameter of about 50-60 mm and preferably of 55 mm. The gel core 12 can be Diphenylmethane-4,4'-Diisocyanate. This gel is available from BASF Headway Polyurethanes (Taiwan) Co., Ltd., No. 11, Jen Cheng Road, Hsinchu Industrial Park, Huko Heian, Hsinchu, Taiwan as a silicon polyurethane gel material referred to under the trade name I-126. It will be appreciated by those skilled in the art that other silicon materials can be used without departing from the invention. Also gels based on other materials than silicon may be used. It may thus also be a gel solely consisting of polyurethane, or similar gels like gels based on polyetherpolyol.

Figure 3:
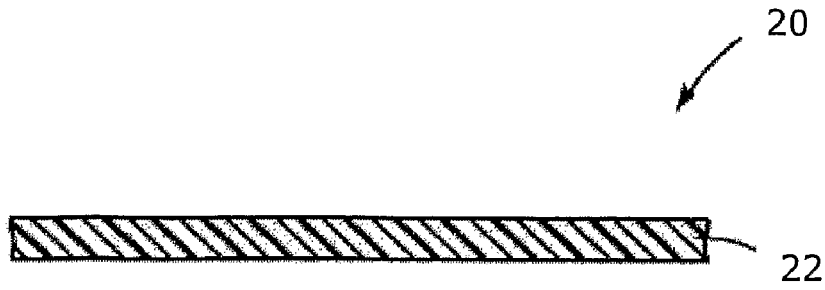
FIG. 3 is a cross-sectional view of a first variation of a shell section of the present invention.

A first variation of a shell section 20 that can be used in all embodiments of the present invention is outlined in FIG. 3, which shows a cross sectional view through this section 20. Here the section includes a layer 22 of stretchable fabric, like some type of woven fabric like LYCRA®. The layer of stretchable fabric 22 here has a thickness of about 0.2-1 mm and preferably about 0.6 mm, As mentioned above, the fabric layer is in one embodiment LYCRA®. LYCRA® was originally developed as a replacement for rubber, and has an ability to stretch up to about 7 times its original length—and then snap back to its starting size with no loss to its spring. There is really no such thing as a commercially available fabric made entirely of LYCRA®. It's never used alone, but is always combined with another fiber (or fibers), both natural or man-made. As little as 2 percent LYCRA® is enough to improve a woven fabric's movement and its knack for holding its shape. The shell section provides an outer surface of the ball that is easy and comfortable to hold in the hand.

LYCRA® is a man-made elastomeric fiber, invented and produced by DuPont Corporation. Generically, these kind of fibers are known as spandex in the US and Canada and as elastane in Europe. LYCRA® is a "segmented polyurethane." While LYCRA® appears to be a single, continuous thread, it is actually a bundle of tiny filaments. It's this unique molecular structure that gives LYCRA® its built-in, lasting elasticity. Stretch it four to seven times its original length, yet the fiber still returns to its starting size once the tension is released.

The shell section 20 and the core 12 thus enables the provision of a ball that is comfortable to handle and bounces well on water. However this combination when provided alone tends to provide a ball that is too heavy and does not float well. It would then tend to sink after a while and before that to float up to the surface slowly, which might degrade the enjoyment of the water game. The density of the gel could be made lower in order to improve the floating properties, but then the bouncing properties are degraded.

In order to enhance the floating properties while still retaining the good bouncing properties, the floating enhancement section is provided. In the first embodiment the plastic material layer 16 of the floating enhancement section 14 is a layer of non-porous plastic material, which can be a thermoplastic material and in one embodiment polyethylene (PE). This material does in itself lower the total density of the ball and thus enhances the floating capability. However the enclosed gas further enhances this floating capability even more. The plastic material layer 16 is furthermore preferably very thin and provided as a foil. The thickness of the layer is preferably in the range of 0.05-0.2 and preferably 0.1 mm. In this way the good bouncing properties of the gel are still retained. The stretchable fabric of the elastic shell section 20 furthermore provides an even pressure on the plastic material layer 16, which evenly distributes the air pressure around the gel core.

This first exemplifying embodiment thus allows the provision of a relatively large ball having both good bouncing and floating properties. This is advantageous for aquatic beach use on lakes or in the sea.

This first embodiment can be varied in that the floating enhancement section includes two layers of plastic material, one adjacent the gel core and one adjacent the outer shell section. Between these two layers there is provided a cavity filled with a gas and preferably air.

Figure 4:
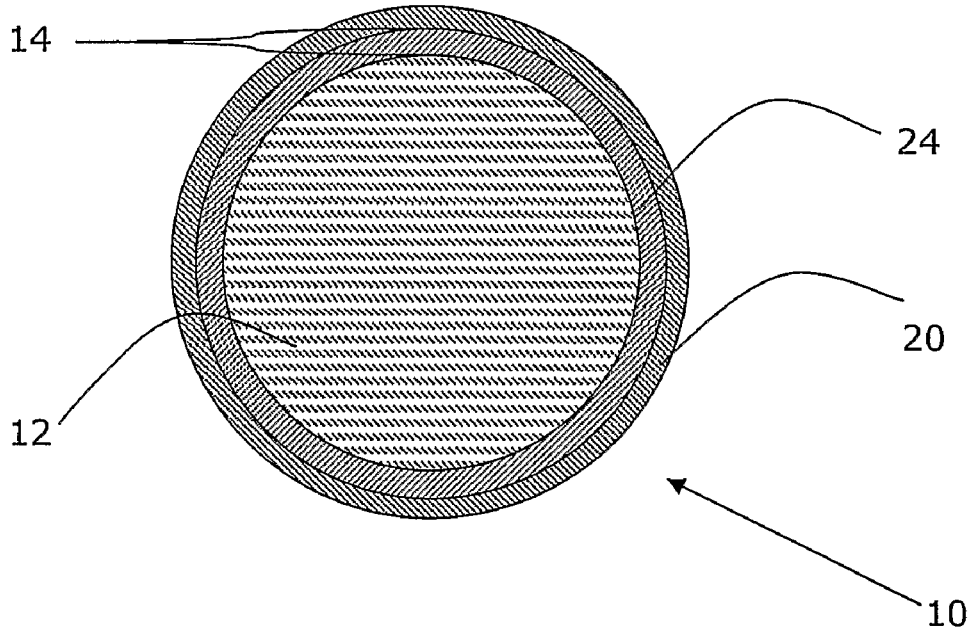
FIG. 4 is a cross-sectional view of a ball according to a second embodiment of the present invention.

A second exemplifying embodiment of the ball according to the present invention will now be described in relation to FIG. 4, which shows a cross sectional view through the ball 10. As in the first embodiment there is a gel core 12 of a type of material that has been described in relation to the first embodiment. This core thus only includes the gel. There is also provided a shell section 20, which may be of the type described in relation to FIG. 3. Between the gel core 12 and the shell section 20, the floating enhancement section 14 is provided. Here the floating enhancement section 14 is solely made up of a layer of porous plastic material 24, which in this embodiment is styrene-butadiene-rubber. It can however be another material like neoprene or similar materials. Styrene-butadiene rubber is solid, elastic and flexible and includes air so that the density of the material makes the ball light enough to float well while still retaining the good bouncing quality of the gel. The layer 24 is in the area of 0.5-1.5 mm and preferably about 1 mm thick.

It should be realized that the first and second embodiments can be combined, i.e. that both a layer of porous plastic material like styrene-butadiene rubber and a non-porous plastic material like polyethylene enclosing an air gap can be provided in the floating enhancement section. In this case the styrene-butadiene rubber may have a preferred thickness of about 0.5 mm instead.

Figure 5:
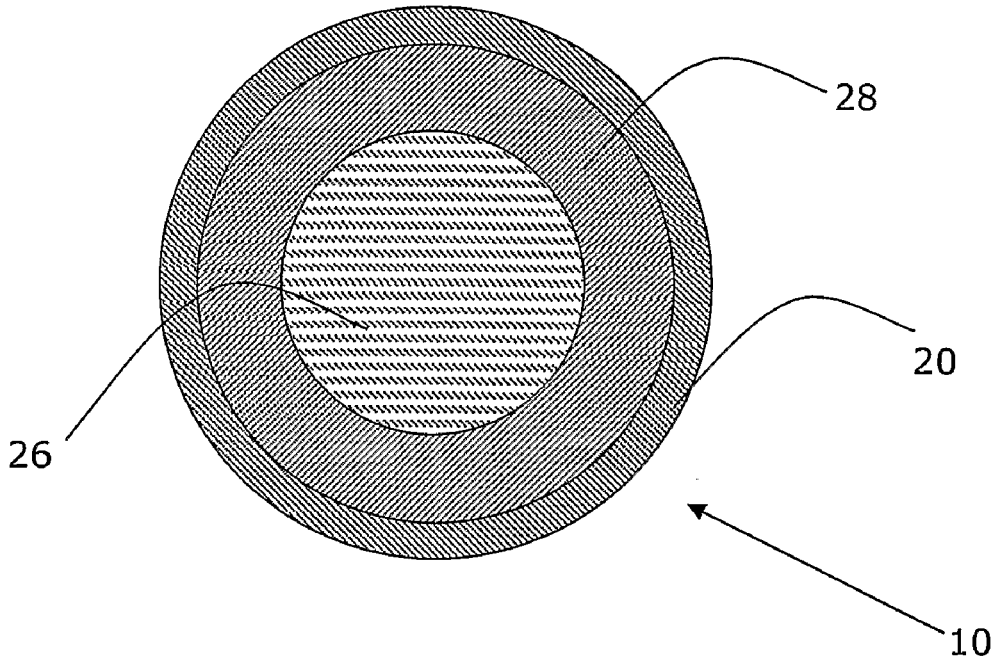
FIG. 5 is a cross-sectional view of a ball according to a third embodiment of the present invention.

A third exemplifying embodiment of the ball according to the present invention will now be described in relation to FIG. 5, which shows a cross sectional view through the ball 10.

Here the floating enhancement section is provided as the core 26 of the ball, and in the form of a foamed plastics or porous plastic material, preferably in the form of foamed polyurethane. Thus here air is included in the plastics material when the foam is formed. The diameter of the core 26 can here range between 30 and 40 mm. Around this foam core 26, the gel section is provided as a gel layer 28 only including gel, which gel is of any of the materials described above in relation to FIGS. 2 and 4. The thickness of the gel layer 28 can here typically range between 5 and 10 mm and the diameter of the core and gel layer combination preferably be about 50 mm. On top of the gel layer 28 there is provided a shell section 20.

By providing such a foam core, the density of the whole ball is reduced compared with the use of a gel core, while still taking advantage of the bouncing properties of the gel. Thus a ball that floats better and has good bouncing properties is obtained. This solution furthermore enables the provision of a small ball suitable for use in water games for children and/or for use in swimming pools. Typically this allows the provision of a ball having a diameter of about 50 mm.

It is possible to vary this floating enhancement section of the third embodiment by exchanging the core having a porous plastic material with a layer of non-porous plastic material enclosing a gas, like air. The gas would then be provided in a closed cavity in the centre of the ball, where a layer of porous plastic material would form the wall of the cavity. Outside this layer would then follow the gel layer which in turn is followed by the outer shell section. The non-porous plastic material might then be made of the same materials mentioned in relation to the first embodiment.

Figure 6:
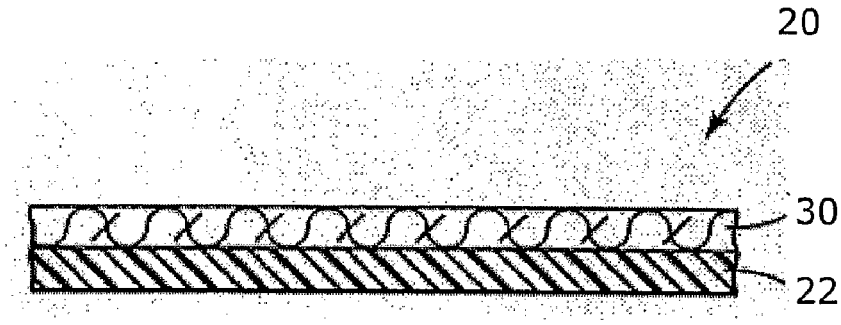
FIG. 6 is a cross-sectional view of a second variation of a shell section of the present invention.

A second variation of the shell section that can be used in all the embodiments of the present invention is outlined in FIG. 6, which shows a cross sectional view through this section 20. The section here also comprises a layer of stretchable fabric 22, like LYCRA®, beneath which a shell enhancement layer 30 is provided.

The shell enhancement layer 30 may be a polyurethane layer (PU). It should be realized that other materials than PU can be used, like for instance styrene-butadiene-rubber, neoprene or similar materials. The PU layer 30 acts as a water barrier stopping some of the water from entering the ball. However the shell section 20 normally comprises stitches when the stretchable fabric is being fastened to the shell enhancement layer 30, which will allow some water to pass through the shell enhancement layer 30.

The stretchable fabric layer 22 may have the same thickness as was described in the first variation, while the enhancement layer may have a thickness of about 0.5-1.5 mm and preferably about 1 mm. Thus here the shell section 20 may thus have a thickness ranging from 0.7-2.5 mm an preferably be about 1.6 mm thick.

The bounce of a ball may also be dependent on other factors than the properties of the gel. Generally the bounce can be dependent on factors like the angle of incidence at the water surface, the mass of the ball, the speed of the ball at the time of impact on the water surface, the centre of gravity of the ball and how hard the ball surface is. As the ball according to the present invention is provided with a gel, the centre of gravity at the time of impact on the water surface gets shifted, which makes the ball bounce off from the water. This shift is then also at least partly dependent on these other factors as well as the type of core used, i.e. whether the core is a foamed plastics core surrounded by a gel or a gel core provided with an outer floating enhancement section.

The balls according to all three described embodiments have proven to have good bouncing properties, where a foamed plastics core enhances the bouncing properties of small balls with a diameter of about 50 mm, but not of bigger balls with a diameter of about 55 mm.

With the present invention there is therefore provided a ball that bounces well on water due to the properties of the gel section while at the same time being able to float well because of the floating enhancement section. This is of advantage when a ball is needed that, when thrown on a water surface, can have a trajectory enabling several bounces and also floats well on the water surface.

Although specific embodiments have been illustrated and described herein, it will be appreciated by those of ordinary skill in the art that any arrangement that is calculated to achieve the same purpose may be substituted for the specific embodiment shown. This application is intended to cover any adaptations or variations of the present invention. Therefore, it is manifestly intended that this invention be limited only by the claims and the equivalents thereof.

The invention claimed is:

1. A ball suitable for water games, the ball comprising:

a gel section only comprising a gel and having an exterior surface;

an outer elastic shell section provided above the exterior surface of the gel section; and a floating enhancement section in an interior of the ball adjacent the gel section and comprising a plastic material and gas;

wherein the gel section is provided as a core of the ball, the plastic material of the floating enhancement section is provided around the gel section and comprising at least one layer of plastic material between the gel core and the outer elastic shell section, and the diameter of the gel core is larger than the thickness of the floating enhancement section.

2. The ball according to claim 1, wherein the floating enhancement section comprises a porous plastic material, which includes said gas.

3. The ball according to claim 2, wherein the porous plastic material is a foamed plastic material.

4. The ball according to claim 2, wherein the porous plastic material is styrene-butadiene rubber.

5. The ball according to claim 2, wherein the thickness of the porous plastic material is in the range of between 0.5 and 1.5 mm.

6. The ball according to claim 1, wherein the floating enhancement section comprises a cavity only filled with gas and defined by a layer of non-porous plastic material.

7. The ball according to claim 6, wherein said layer of plastic material is formed of a thermoplastic material.

8. The ball according to claim 6, wherein the thickness of the non-porous plastic material is in the range of between 0.05 and 0.2 mm.

9. The ball according to claim 1, wherein the outer elastic shell section comprises a stretchable fabric layer.

10. The ball according to claim 9, wherein the outer elastic shell section comprises a shell enhancement layer fastened to the stretchable fabric layer.

* * * * *